US005295592A

United States Patent [19]

Thorne

[11] Patent Number: 5,295,592

[45] Date of Patent: Mar. 22, 1994

[54] ARTICLE DISPENSER

[76] Inventor: Ross T. Thorne, 60 Marigold Street, Revesby, New South Wales 2212, Australia

[21] Appl. No.: 942,928

[22] Filed: Sep. 10, 1992

[30] Foreign Application Priority Data

Sep. 11, 1991 [AU] Australia ..... PK8296

[51] Int. Cl.[5] ..... A47F 1/00

[52] U.S. Cl. ..... 211/59.2; 312/42; 221/194; 221/311

[58] Field of Search ..... 211/59.2; 312/42, 45, 312/60; 221/194, 191, 311

[56] References Cited

U.S. PATENT DOCUMENTS

| | | | |
|---|---|---|---|
| 730,871 | 6/1903 | Callander | 221/311 |
| 1,576,010 | 3/1926 | Swartz | 221/311 |
| 1,618,178 | 2/1927 | Erdoes | 312/45 |
| 2,289,751 | 7/1942 | Brenholt | 211/59.2 |
| 3,433,545 | 3/1969 | Rainey | 312/42 |
| 3,502,382 | 3/1970 | Rainey | 312/42 |
| 4,037,756 | 7/1977 | Jaquish | 312/42 |
| 4,479,583 | 10/1984 | Franklin et al. | 211/59.2 |
| 4,779,745 | 10/1988 | Prendergast et al. | 211/59.2 |

FOREIGN PATENT DOCUMENTS

| | | | |
|---|---|---|---|
| 0345680 | 12/1989 | European Pat. Off. | 221/191 |

*Primary Examiner*—Paula A. Bradley
*Assistant Examiner*—Erik R. Puknys
*Attorney, Agent, or Firm*—Edwin D. Schindler

[57] ABSTRACT

A dispenser including a storage zone to receive a column of said like articles, a resilient first abutment engagable by a rear corner of the lowest article in storage zone, said dispenser also including a dispensing zone having an inclined article support with a lower end stop disposed below the storage zone, the distance in the plane of said inclined support from said stop to the bottom face of the lowest article in the storage zone allows at least two articles to rest thereon is edge to edge relationship with edges of the first and last of the articles on the support respectively in contact with said stop means and the bottom face of the lowest article in the storage zone to provide a further abutment on which the lowest article in said storage zone will rest, on removal of a lowermost article from the support the other article(s) thereon will move downwardly and withdraw the further abutment and the lowermost article in the storage zone will pivot about its engagement with the first abutment with outward deflection of the first abutment during transition from a horizontal condition in the storage zone to an inclined condition as the uppermost article on the support.

9 Claims, 5 Drawing Sheets

FIG. 12.
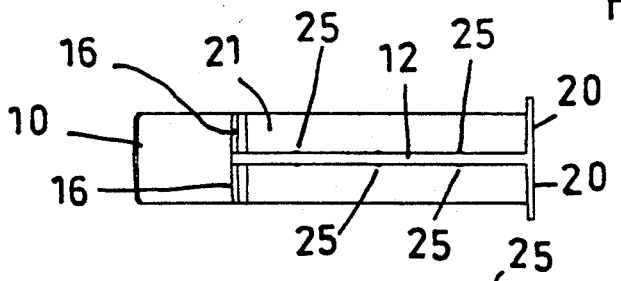
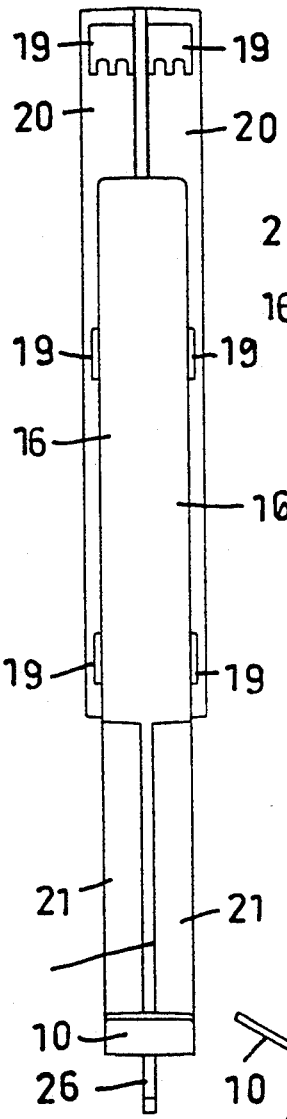
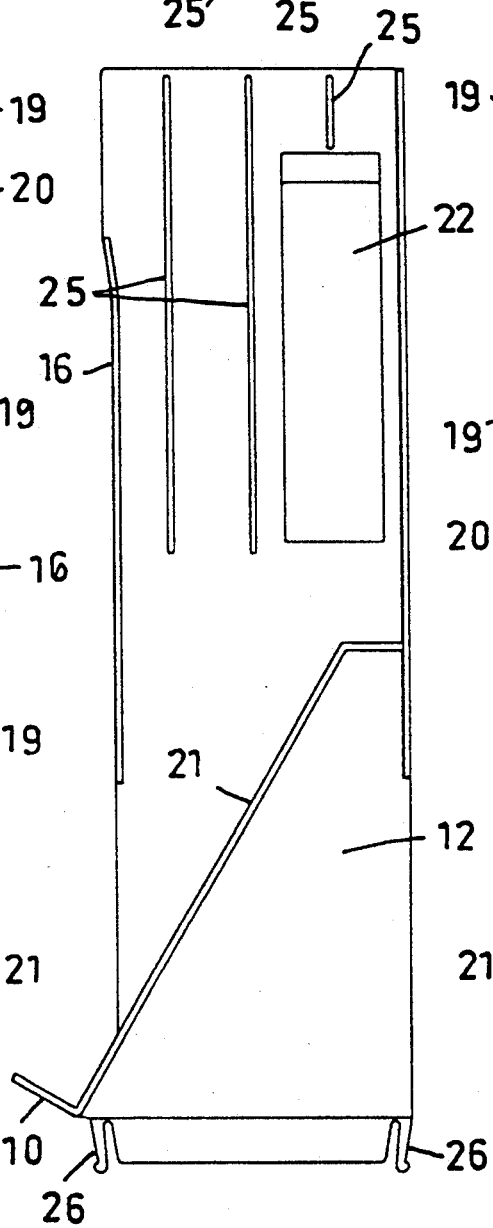
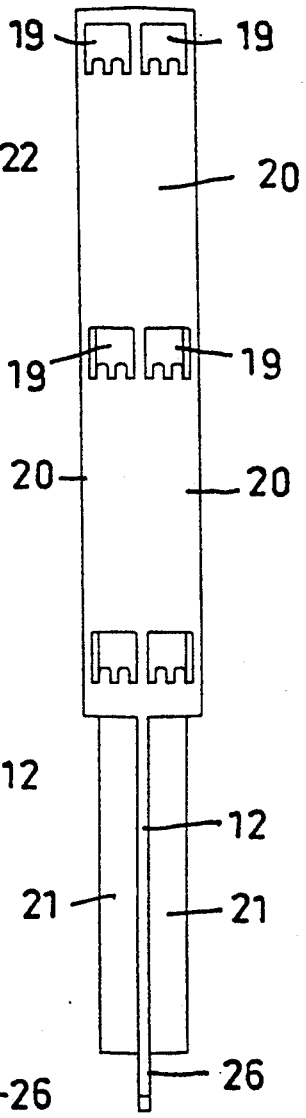
FIG. 11. FIG. 9. FIG. 10.

ARTICLE DISPENSER

This invention relates to dispensers of the type for storing a number of articles of uniform shape and size, and which allows the articles to be removed one at a time from a dispensing zone which continues to be filled (after each article is removed) so long as there is stock in the dispenser.

The term article as used herein is intended to include a container for an item or items which is of at least semi-rigid form allowing it to maintain that form when subjected to point or line support. Whilst the configuration of the container can vary widely one which is of rectangular shape, a cigarette pack being an example, is the most likely form of container to be used in the dispenser. Articles not of rectangular shape but having a pair of substantially parallel spaced apart faces and a pair of substantially parallel edge zones and a pair of substantially parallel end zones are suitable for dispensing by the dispenser of the invention.

The dispenser has been particularly designed with several objects in mind. The dispenser includes a storage zone and a dispensing zone and one objective of the invention is to provide a dispenser which displays a major face of one or more articles in the dispensing zone so that the identity of an article can be readily established. This provides an opportunity to expose a person passing the dispenser to a presentation face of the article where the manufacturer has the brand name prominently displayed. Such exposure can act as a stimulus to buy and for that reason it is likely that the dispenser of the present invention would be positioned at the checkout of a supermarket or like location. The dispenser by its design and mode of operation also saves space on a shelf in a store or on a supermarket shelf as its footprint is considerably less than current dispensers used to dispense the type of article for which this dispenser has been primarily designed.

Broadly stated the present invention provides a dispenser for similarly shaped articles which are at least semi-rigid and where each has a pair of substantially parallel spaced apart faces and a pair of substantially parallel edge zones and a pair of substantially parallel ends zones, said dispenser including a storage zone with a back and a front to receive a number of said articles in face to face and substantially horizontal condition, guide means in the storage zone which will lie closely adjacent the side and end zones of articles passing through the storage zone, a deflectable first abutment at the back of and below said storage zone resiliently biassed to an operative position where it is engagable by the bottom face of the lowest article in said storage zone at or closely adjacent one of the edge zones of the lowest article, said dispenser also including a dispensing zone having an inclined article support means disposed below the storage zone with an upper end adjacent said first abutment and a lower end and a stop means at or adjacent said lower end, the distance in the plane of said inclined support means from said stop means to the bottom face of the lowest article in the storage zone is such that at least two inclined articles can be supported on said support means with corresponding faces of the inclined articles engaging said support means with the adjacent edge zones of the inclined articles in contact and with portions of the other edge zones of the first and last of the inclined articles in contact with said stop means and the bottom face of the lowest article in the storage zone to thereby provide a further abutment on which the lowest article in said storage zone will rest, whereby on removal of a lowermost article from said inclined support means the other article(s) thereon will move downwardly thereby withdrawing said further abutment from the lowermost article in said storage zone allowing it to pivot about its engagement with said first abutment and with the weight of the pivoting article causing some resilient outward deflection of said first abutment means during its transition from a horizontal condition to an inclined condition as the uppermost article on said inclined support means where an edge zone thereof will provide the further abutment for the now lowest article in the storage zone.

Presently preferred forms of the dispenser will now be described with reference to the accompanying drawings in which:

FIG. 1 is a diagrammatic illustration of the dispenser of the invention to illustrate the concept involved, FIG. 2 is a view similar to FIG. 1 showing a stage in the dispensing of an article, FIG. 3 is a view similar to FIG. 1 showing a further stage in the dispensing of an article, FIG. 4 is a perspective view of a preferred construction of a dispenser according to the invention which allows for a plurality of dispensers of variable width to be mounted on a single base, FIG. 5 is a view similar to FIG. 4 with a side member of the dispenser removed to facilitate description of some of the dispenser parts, FIG. 6 is a side view of the back member of the dispenser, FIG. 7 is an edge view of the back member of FIG. 6.

FIG. 9 is a side view of a side member of the dispenser,

FIG. 10 is a back edge view of the side member of FIG. 9,

FIG. 11 is a front edge view of the side member of FIG. 9 and,

FIG. 12 is a top view of the side member of FIG. 9.

Figure 1:
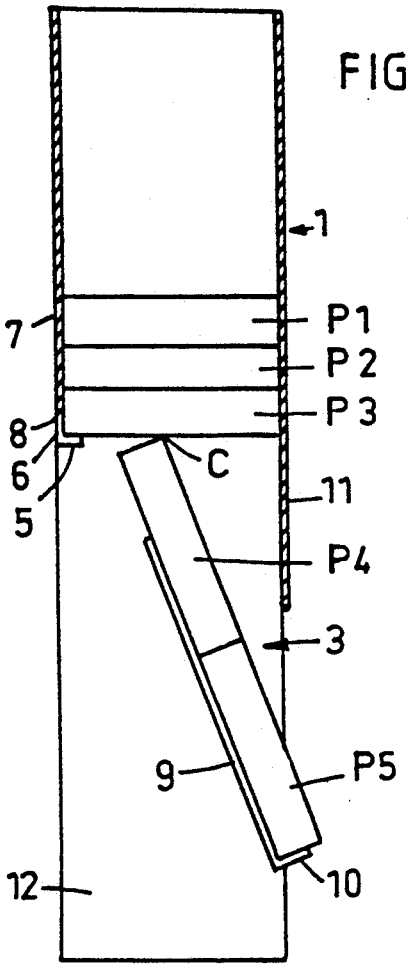

As illustrated in FIG. 1, the dispenser 1 includes a storage zone 2 for a single column of articles but as will be understood this is representative and dispensers with tandem storage zones (as will hereinafter be described) are likely to be used in commerce. The storage zone 2 is dimensioned to received the articles with sufficient clearance to allow the articles to fall freely under gravity from the dispenser top 4 to the dispensing zone of the dispenser. The inner surface of the storage zone can be ribbed or otherwise adapted to minimise the frictional resistance to travel of the packages through the storage zone and to also allow the ready escape of cushioning air from between articles as they are initially loaded into the storage zone.

Whilst the form of the dispenser of FIG. 1 provides solid panels for the walls of the storage zone 2 to support, guide and confine the articles it would be within the scope of the invention to form the storage zone from rods or in other ways to control the articles in their travel from the open top of the storage zone to adjacent the dispensing zone of the dispenser.

The articles are necessarily at least semi-rigid in form so as to maintain that form when subjected to point or line support. An article of rectangular shape is the obvious type for dispensing but articles of other forms can be dispensed. The requirements of the article for dispensing is that is should have a pair of substantially parallel spaced apart surfaces and a pair of substantially parallel edge zones and a pair of substantially parallel end zones. A square article with cut corners (e.g. an irregular octagon) would comply with this requirement. Other shapes which provide support engagable end and edge zones of the above type can also be dispensed.

The system used to replenish the dispensing zone of the dispenser on removal of an article involves a transition of the articles from a generally horizontal orientation (articles P1 to P3 in FIG. 1) to an inclined position (articles P4 and P5 in FIG. 1). It is to be understood that the number of articles having an inclined orientation can be greater than two and the modification of the dispenser to accommodate more than two articles in the inclined position can be readily achieved.

In order to achieve the article transition a first abutment 5 is provided. It is shown as being of shoulder form and this abutment plus the interaction between articles P3 and P4 which provides a second abutment as the article P5 is removed results in the repositioning of the article P3 to the position previously occupied by the article P4. The transition of the article P3 is described later in detail.

The abutment 5 is at the bottom of a resilient leg 6 which is part of the back member 7 of the storage zone 2. The length and form and material of manufacture of the leg 6 regulates its resilience and in a preferred configuration of the dispenser the leg 6 would be associated with means to modify its resilience as required by the article being handled. For example the leg 6 may be adapted for demounting from the back member 7 and the abutment 5 may be demountable from the leg 6 or repositionable therealong. The back panel 7 has a lower edge 8 which terminates at an elevation above the abutment 5. The ability to adjust the distance between the abutment 5 and the panel edge 8 is seen as a desirable feature of the dispenser in order to add to its versatility.

The article P5 is supported together with the article P4 on an inclined support 9 with a stop 10 at its lowermost edge. The lowermost edge 3 of the storage zone front member 11 is preferably positioned so that the upper face of at least the article P5 can be viewed.

The arrangement of components and the positioning thereof is related to the size of the article to be dispensed. In FIG. 1 it will be seen that with the articles P5 and P4 supported by the support 9 the top edge corner of the article P4 engages the article P3 at C thereby to provide a second abutment. The articles in the storage zone are supported laterally by the side members 12. The article P3 is supported by the back member 7 down to the edge 8, which lies at about the mid-thickness of the article P3. The front member 11 of the storage zone extends below the article P3. The article P3 has its underface adjacent its back edge zone resting on the first abutment 5.

Figure 2:
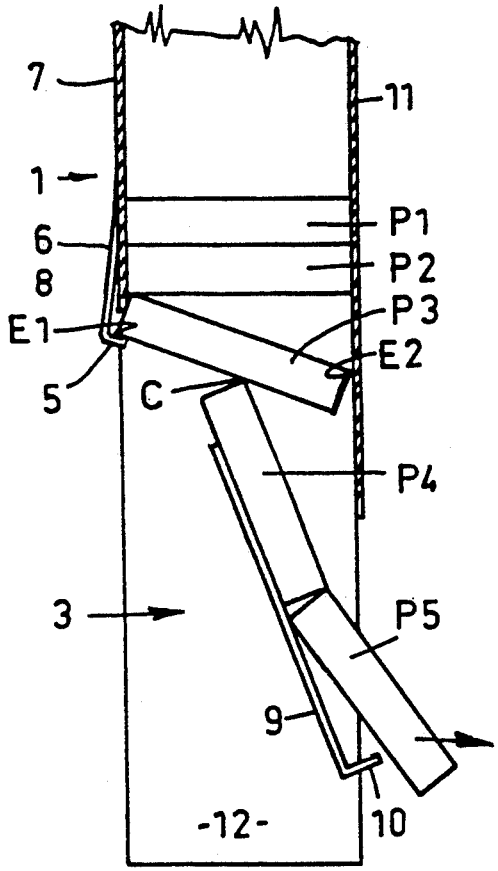

Referring now to FIG. 2, which is a view showing the position the articles P3 and P4 adopt when the article P5 is partly removed. It will be seen that when the bottom of the article P5 is moved in the direction of the arrow, by the finger of a user of the dispenser (entered for example into a gap in the stop means 10) the article P4 will move downwardly in unison with article P5 whilst supported by the top edge zone of the article P5. The article P3 is held firmly in contact with the first abutment 5 by the weight of the articles P1 and P2 and is supported intermediate its width on a back edge corner of the article P4 at C, which provides the support abutment for the article P3.

As P4 moves down the article P3 the second abutment support C for P3 is withdrawn and P3 will want to move arcuately about the abutment 5. This movement would normally be prevented because the diagonal distance between the points E1 and E2 of P3 exceeds the distance between the back member 7 and the front member 11. The resilience of the arm 6 accommodates this problem by deflecting to allow the front edge E2 of the article P3 to wipe down the inner face of the front member 11.

Figure 3:
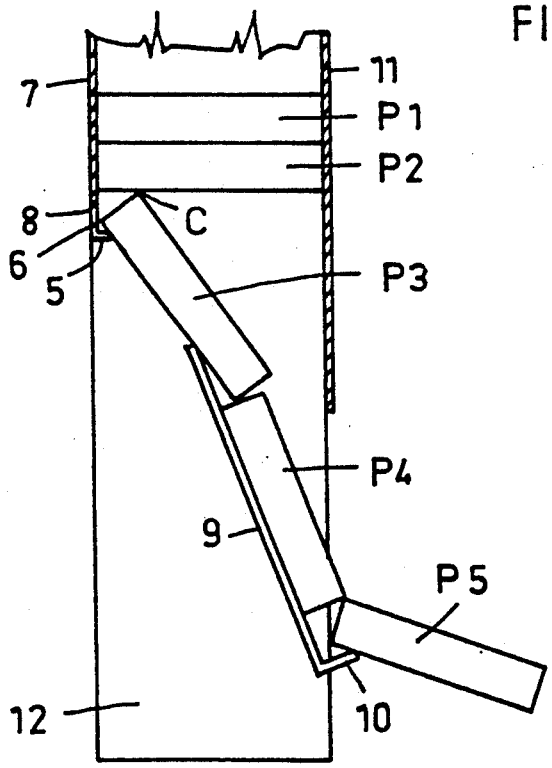
Figure 4:
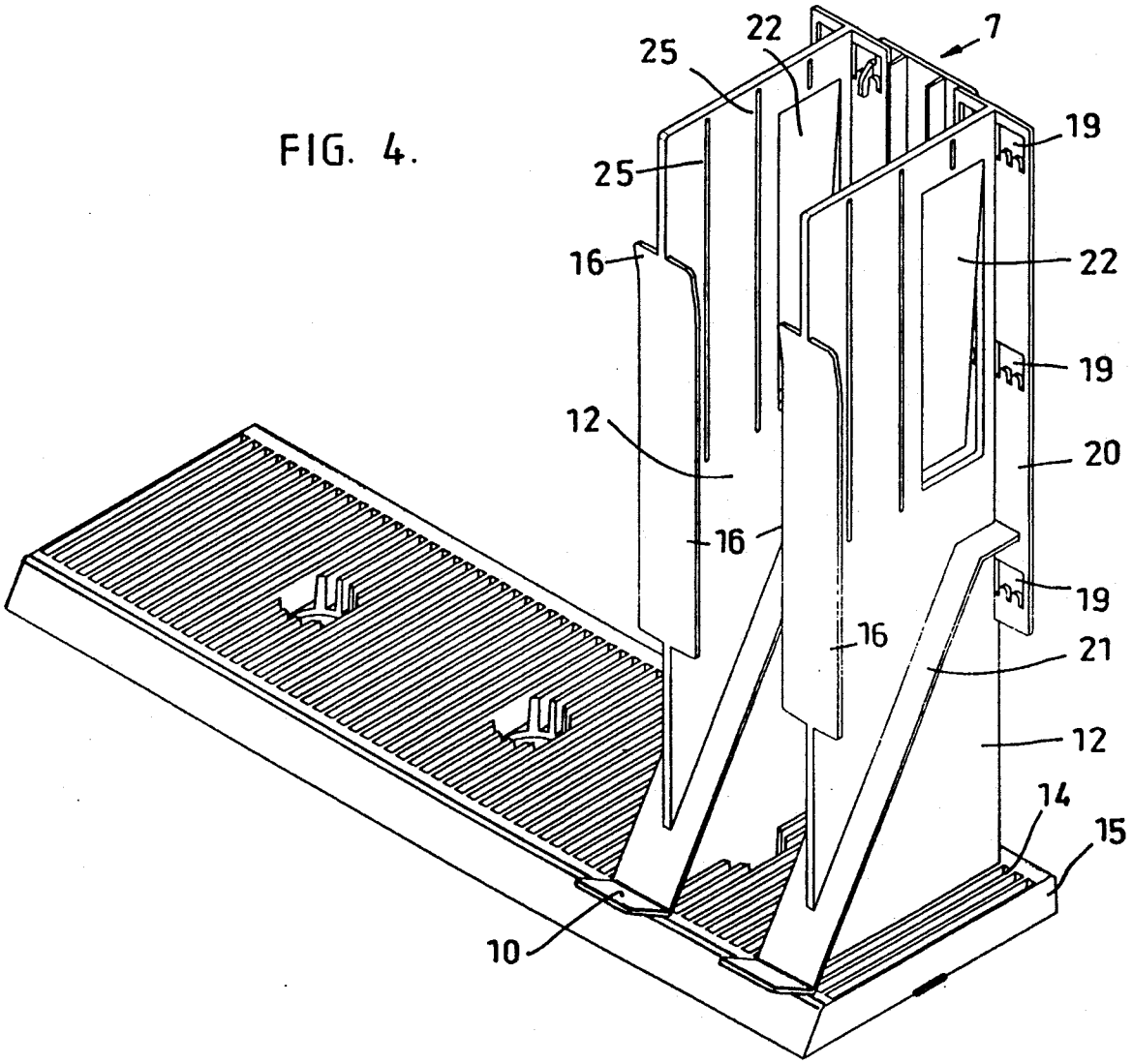
Figure 5:
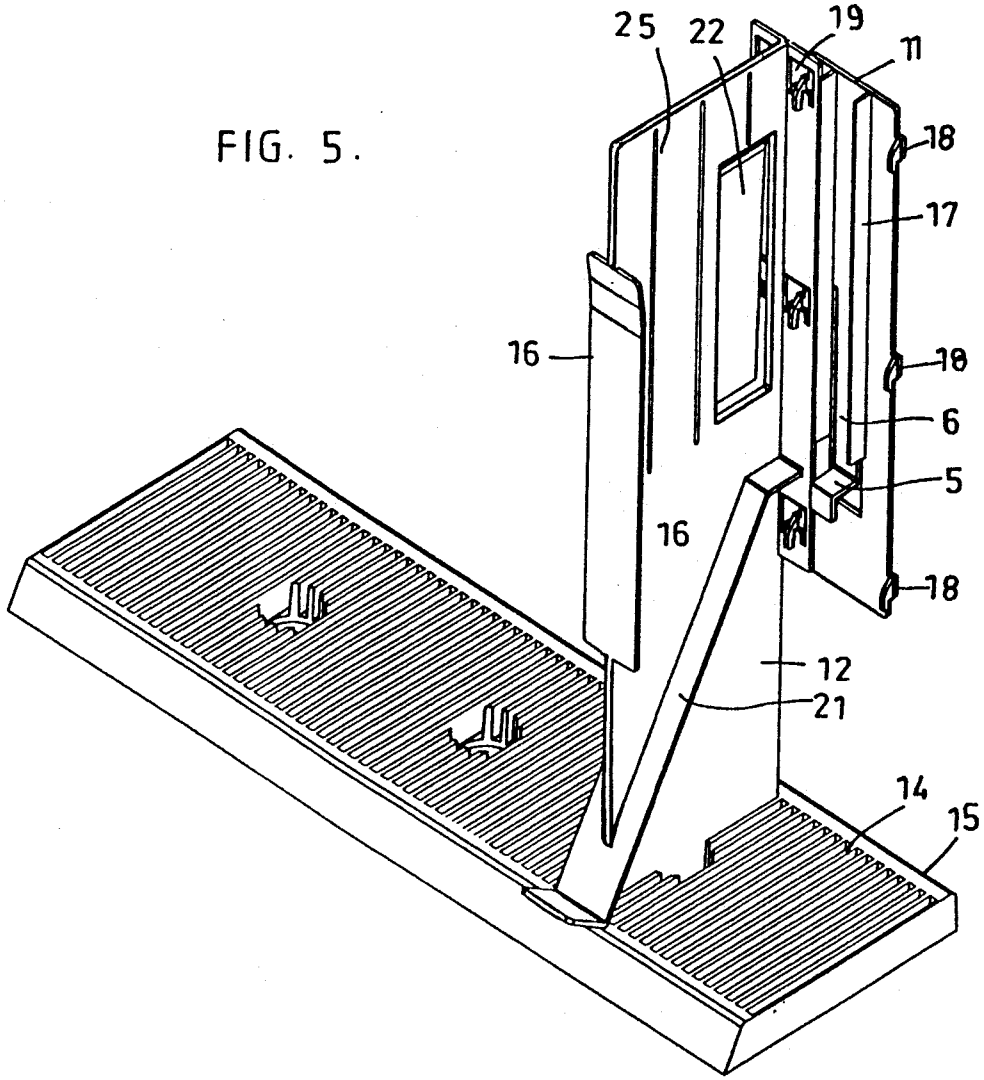

Referring now to FIG. 3 which shows the position of the articles later in the process of removing the article P5. The article P4 has now slid well down the support 9 and the article P3 is almost to the inclination of the support 9 but is still supported on the underface adjacent its top edge by the abutment 5 and on its underface by the top end of the support 9. It is clear that the total removal of the article P5 will result in the re-establishment of an article relationship as shown in FIG. 1.

Having now described the theoretical basis for the operation of the dispenser a preferred commercial embodiment of the invention will be described with reference to the drawings FIGS. 4 to 12. In these FIGS. the component numbering used in FIGS. 1 to 3 has been followed for the equivalent components. For example the side members are identified 12 and the back member is identified 7, however these components are multi-featured as will now be described.

The side members 12 are adapted to be mounted at their lower ends in slots 14 in a base 15 by means of resilient latching legs 26 which are engagable with co-operatively shaped notches in the slots 14. The spacing of the slots 14 is such that the distance between ribs 25 on the inner surfaces of the end members 12 will lie closely adjacent the end zones of an article in the storage zone. The full front member 11 of FIGS. 1 to 3 is replaced by wings 16 on the side members 12. The functioning of the dispenser is not dependent upon the front edges of the articles in the storage zone being completely covered.

Figure 8:
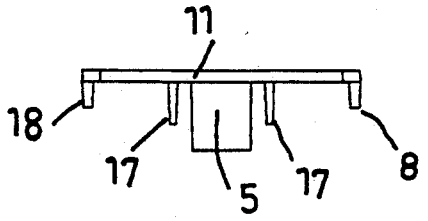
FIG. 8 is a top view of the back member of FIG. 6
Figure 6:
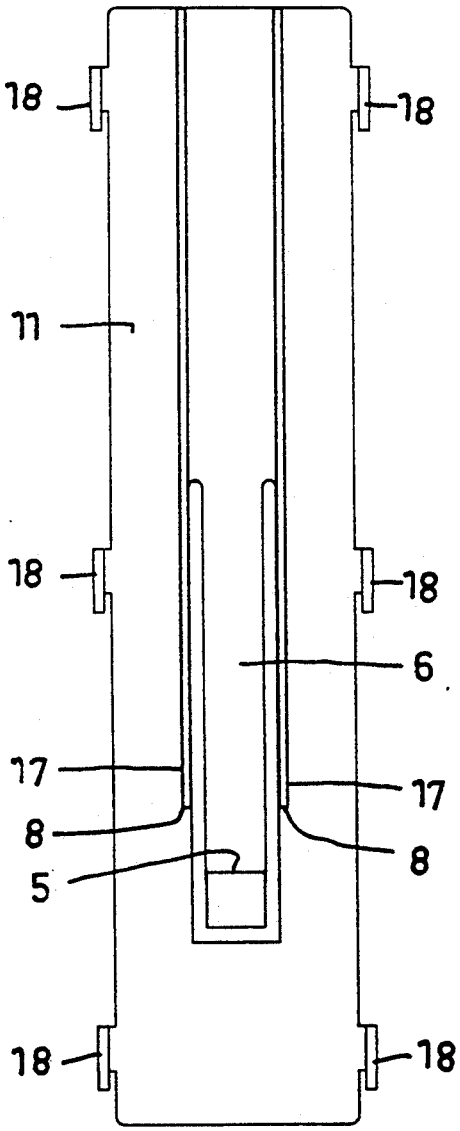
Figure 7:
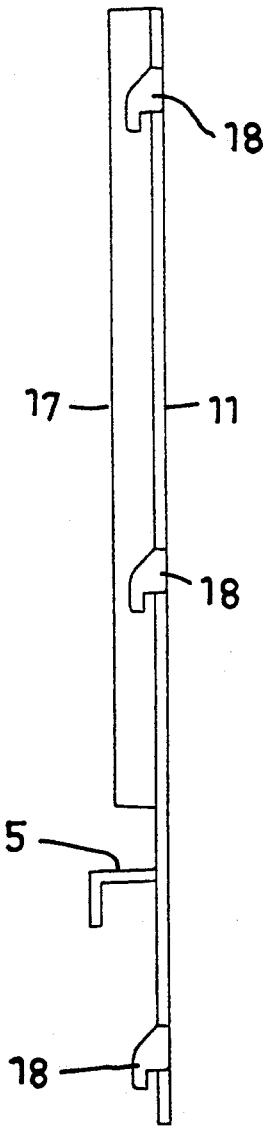

The back member 7 is now a demountable member, see FIGS. 6 to 8, and includes ribs 17 to lie closely adjacent the back edge zones of articles in the storage zone. It also includes upper, intermediate and lower mounting hooks 18 selectively engagable in upper, intermediate and lower multi-position socket groups 19 on wings 20 of the side members 12. The lateral spacing of the sockets in a socket group 19 and the spacing of the slots 14 in the base 15 correspond. As a result relocation of a side member 12 in the base by one slot 14 will result in the back member hooks 18 on one edge of the back member 11 being aligned with a different socket in the co-operating socket groups. In this way three sockets in the socket groups 19 on the opposed wings 20 of two end members 12 will permit five different spacings between the end members 12 with the same back member 11.

The back member 11 also includes the arm 6 and the first abutment 5 as disclosed in FIGS. 1 to 3 and the ribs 17 terminate at 8 as did the back 11. It is to be understood that the arm 6 can be a separate member suitably and, if desired, adjustably mounted on the back member 11. Likewise the first abutment 5 can be a separate element on the leg 6. In this way a comprehensively adjustable arrangement can be obtained for the vertical positioning of the first abutment 5 and for the resilience of the leg 6.

The inclined support 9 of FIGS. 1 to 3 is comprised of two wings 21 extending inwardly from the end members 12.

One aspect not dealt with in the foregoing description is the practical consideration of what will happen when the last article in the storage zone is to re-oriented as there will be no articles P1 or P2 to apply downward load on the last article in the storage zone. To simulate the presence of an article above the last article to be dispensed a resilient blade 22 is provided in each end member 12. There is one blade 22 for each storage zone and the engagement of the lower edge of the blade 22 with the article therebelow (the last article to be transferred from the storage zone) simulates the load that would be applied if there was still an article above the last article in the storage zone.

It will be seen for the foregoing that the embodiment of FIGS. 4 to 12 provides a dispenser with great versatility and simply by providing modular back members 11 with different lateral spacing between the hooks 18 many different lengths of article can be accommodated. Different widths of article can be accommodated by providing back members 11 where the ribs 17 are of different height.

The foregoing are descriptions of preferred constructions for carrying out the invention as hereinafter claimed. It is to be understood that modifications and variations can be made to the constructions described and illustrated without departing from the inventive concept herein disclosed.

I claim:

1. A dispenser for similarly-shaped articles, said articles being at least semi-rigid and including six surfaces comprising a pair of faces, a pair of ends and a pair of edges, said dispenser comprising:

a storage zone having an upper filling end and a lower discharge end, said storage zone further including a front and a back terminating at said discharge end;

guide means in said storage zone for aligning the ends and the edges of said articles in said storage zone, said guide means including front guide means extending beyond said discharge end of said storage zone;

a resilient arm at the back of said storage zone;

an extension on said resilient arm for providing a first abutment located beyond said discharge end of said storage zone projecting across said discharge end for supporting a back edge of a lowermost article housed in said storage zone;

a dispensing zone including an elongated inclined article support surface with an upper end located below said discharge end of said storage zone;

stop means on the elongated inclined article support surface spaced from said first abutment in a length direction of said article support surface by a distance sufficient for accommodating an article group comprising at least two articles with corresponding faces on said article support surface and with edges of adjacent articles abutting and with distal edges of article group respectively abutting said stop means and providing a further abutment disposed between said first abutment and said front guide means for also supporting a lowermost article housed in said storage zone, said resilient arm being deflectable on removal of said further abutment for allowing the lowermost article in said storage zone to rotate from a horizontal condition to an inclined condition, wherein the lowermost article rests on said support surface while the back edge of the lowermost article is supported by said first abutment and a front edge of the lowermost article is held in contact with and said front guide means by said resilient arm.

2. The dispenser according to claim 1, further comprising two side members extending between and joining the front and back of said storage zone and coupling means for demountably coupling said back to said side members.

3. The dispenser according to claim 2, wherein said guide means comprise raised lands on said side members and said back and said front guide means is defined by wings extending towards each other from side members.

4. The dispenser according to claim 2, wherein said inclined article support surface comprises wings extending towards each other from respective side members.

5. The dispenser according to claim 2, further comprising a base with a number of mounting locations for side members wherein spacing between said side members is changeable.

6. The dispenser according to claim 2, wherein said coupling means for said back provides a number of coupling positions permitting one back to be used for a number of different side member spacings.

7. The dispenser according to claim 2, further comprising a supplemental abutment on at least one side member for facilitating transition of a last article in said storage zone from a horizontal condition in said storage zone ton an inclined condition in said dispensing zone, each said supplemental abutment being resiliently deflectable from a position where it intrudes into said storage zone, said supplemental abutment being located adjacent said first abutment and being spaced thereabove by a distance approximating but greater than the thickness of a said article between the faces thereof.

8. The dispenser according to claim 1, wherein the position of said first abutment is adjustable in a direction of movement of said articles through said storage zone.

9. A dispenser with multiple storage and dispensing zones comprising a base as claimed in claim 6 and a number of side members sufficient for providing said storage zone and said dispensing zone.

* * * * *